US006086189A

United States Patent [19]

Hosono et al.

[11] Patent Number: 6,086,189

[45] Date of Patent: Jul. 11, 2000

[54] INK JET RECORDING APPARATUS FOR ADJUSTING TIME CONSTANT OF EXPANSION/CONTRACTION OF PIEZOELECTRIC ELEMENT

[75] Inventors: Satoru Hosono; Toshihisa Saruta, both of Nagano, Japan

[73] Assignee: Seiko Epson Corporation, Tokyo, Japan

[21] Appl. No.: 09/161,492

[22] Filed: Sep. 28, 1998

Related U.S. Application Data

[62] Division of application No. 08/631,231, Apr. 12, 1996.

[30] Foreign Application Priority Data

Apr. 14, 1995 [JP] Japan ..... 7-113987
Mar. 18, 1996 [JP] Japan ..... 8-90515

[51] Int. Cl.[7] ..... B41J 2/045
[52] U.S. Cl. ..... 347/70; 347/15
[58] Field of Search ..... 347/10, 15, 68–72

[56] References Cited

U.S. PATENT DOCUMENTS

| | | | |
|---|---|---|---|
| 4,513,299 | 4/1985 | Lee et al. | 347/15 |
| 4,686,539 | 8/1987 | Schimidle et al. | 347/15 |
| 4,714,935 | 12/1987 | Yamamoto et al. | 347/10 R |
| 5,285,215 | 2/1994 | Liker | 347/10 X |
| 5,552,809 | 9/1996 | Hosono et al. | 347/10 |
| 5,610,637 | 3/1997 | Sekiya et al. | 347/15 |
| 5,668,579 | 9/1997 | Fujii et al. | 347/10 |

FOREIGN PATENT DOCUMENTS

| | | | |
|---|---|---|---|
| 0115180 | 8/1984 | European Pat. Off. . | |
| 0194852 | 8/1986 | European Pat. Off. . | |
| 59-133066 | 7/1984 | Japan | B41J 3/04 |
| 574016A2 | 12/1993 | Japan | 347/10 |
| 2157623 | 10/1985 | United Kingdom | B41J 3/04 |

OTHER PUBLICATIONS

Patent Abstracts of Japan, vol. 18, No. 173 (M–1581), Mar. 24, 1994, & JP–A–05 338165 (Ricoh Co Ltd), Dec. 21, 1993, *abstract.

Patent Abstracts of Japan, vol. 7, No. 98 (M–210), Apr. 26, 1983, & JP–A–05 338165 (Nippon Denki K.K.) Feb. 5, 1983, *abstract.

Patent Abstracts of Japan, vol. 18, No. 173 (M–1581), Mar. 24, 1994 & JP–A–05 0338164 (Ricoh Co Ltd), Dec. 21, 1993, *abstract.

*Primary Examiner*—John Barlow
*Assistant Examiner*—C. Dickens
*Attorney, Agent, or Firm*—Sughrue, Mion, Zinn, Macpeak & Seas, PLLC

[57] ABSTRACT

An ink jet recording apparatus which jets out a plurality of ink droplets at a predetermined cycle within a single drive period and such that the ink droplets are combined in the air to form a single ink droplet which is supplied to a recording sheet. A charge pulse generating circuit and a discharge pulse generating circuit which divide a drive period into a plurality of segments and output a pulse signal, having cycle Tp which is larger than the Helmholtz cycle Tc, in synchronism with an auxiliary print signal. A time constant adjusting circuit changes an output waveform of a constant current circuit with the pulse signal to increase the velocity of an ink droplet last jet out so that the velocity of the ink droplet allows the ink droplet to be combined, in the air, with an ink droplet previously jet out.

26 Claims, 12 Drawing Sheets

FIG. 3(a) AUXILIARY PRINT SIGNAL

FIG. 3(b) CHARGE PULSE

FIG. 3(c) PRINT SIGNAL

FIG. 3(d) DISCHARGE PULSE

FIG. 3(e) DRIVE SIGNAL

TIME
V3 = V2 > V1
m3
m2
m1
MOVEMENT DISTANCE

TIME
V3 > V1
MOVEMENT DISTANCE

TIME
m1 + m2 + m3
MOVEMENT DISTANCE

TIME
Vf
MOVEMENT DISTANCE

FIG. 7(a) AUXILIARY PRINT SIGNAL

FIG. 7(b) CHARGE PULSE

FIG. 7(c) PRINT SIGNAL

FIG. 7(d) DISCHARGE PULSE

FIG. 7(e) DRIVE SIGNAL

FIG. 10(a) AUXILIARY PRINT SIGNAL

FIG. 10(b) CHARGE PULSE

FIG. 10(c) PRINT SIGNAL

FIG. 10(d) DISCHARGE PULSE

FIG. 10(e) DRIVE SIGNAL

DRIVE SIGNAL
TP
TP
TP

Ta (m/s)
Tc
15
10
5
0
-5
-10
-15
①
②
③
0
2.5
5.0
7.5
10.5
12.5
15.5
17.5
(μs)

INK JET RECORDING APPARATUS FOR ADJUSTING TIME CONSTANT OF EXPANSION/CONTRACTION OF PIEZOELECTRIC ELEMENT

This is a divisional of application Ser. No. 08/631,231 filed Apr. 12, 1996, the disclosure of which is incoporated herein by reference.

BACKGROUND OF THE INVENTION

1. Field of the Invention

The invention relates to printers that print characters and images on a recording sheet by causing the capacity of pressure producing chambers to be changed by the operation of piezoelectric vibration elements in response to print signals so that ink droplets can be jet out of the corresponding nozzle openings.

2. Background

An ink jet recording head forms images on a recording sheet or the like by jetting ink droplets from the nozzle openings thereof while changing pressure in the pressure producing chambers. In order to improve image quality, small dots at a higher density must be formed on the recording sheet or the like.

Since it is difficult to adjust the quantity of ink in a single ink droplet, many ink droplet adjustment methods involve the step of jetting a plurality of ink droplets in accordance with a density specified by a print signal. However, these methods address the problem that print quality is impaired by satellites and the like.

In order to overcome such problems, e.g., Unexamined Japanese Patent Publication No. Sho. 59-133066 and U.S. Pat. No. 5,285,215 have disclosed the following method. The method involves the steps of: jetting a plurality of ink droplets, which are to form a single ink droplet, from the nozzle openings continuously; causing such plurality of ink droplets to be combined into a single ink droplet during flight; and causing the combined single ink droplet to deposit on a recording sheet. As a result of this method, gradation representation can be implemented without displacements between ink droplets caused by the travelling of the carriage.

This method will be described in more detail. A first portion of pressure change consists of a decrease in the pressure of a pressure producing chamber which increases the capacity of the pressure producing chamber. The increase in pressure is initiated at a front edge portion of a drive pulse. A second portion of pressure change consists of an increase in the pressure of the pressure producing chamber which decreases the capacity of the pressure producing chamber. The decrease in pressure is initiated at the rear edge portion of the drive pulse. This increase in the pressure of the pressure producing chamber causes an ink droplet to be jet out of the pressure producing chamber. Further, the velocity of the second portion of pressure change is proportional to the slope of the rear edge portion of the drive pulse.

The above-described method involves the following steps. First, a voltage is applied to a converter means so that the converter means contracts along the length thereof to thereby increase the capacity of the pressure producing chamber and allow the pressure producing chamber to generate negative pressure therein. As a result of this operation, ink from an ink supply reservoir is caused to flow into the pressure producing chamber so that the pressure producing chamber is filled with the ink.

In the second step, the supply of voltage to the converter means is terminated. As a result, the capacity of the pressure producing chamber is rapidly decreased to thereby allow the ink droplet to be jet out of an orifice.

In the third step, a plurality of continuous drive pulses are supplied to the converter means. In the third step, at least one of the drive pulses is applied within a time period from the end of the last drive pulse to the timing at which the tail end portion continuous to the last ink droplet jet out by the pulse moves away from the orifice, and at least one drive pulse has a larger rear edge portion slope than the last drive pulse.

The fourth step is to repetitively operate the converter means at sequentially decreasing drive cycles, which in turn produces a plurality of predetermined continuous pressure changes in the pressure producing chamber. This operation allows a plurality of predetermined ink droplets, whose velocities are continuously sequentially increasing, to be jet out from the orifices within such a time period as to allow the ink droplets to be combined together during flight.

However, the cycle of the converter means must be sequentially changed, and this operation complicates clock signal design and thus makes print control difficult. The invention has been made in view of such problems.

SUMMARY OF THE INVENTION

The object of the invention is, therefore, to provide a novel ink jet recording apparatus that can form a single dot out of a plurality of ink droplets while maintaining a constant clock signal that manages the basic timing of a print operation.

The ink jet recording apparatus according to the present invention includes: a recording head having a piezoelectric vibration element whose natural vibration cycle is Ta, and a pressure producing chamber having a Helmholtz cycle of Tc, the pressure producing chamber being expanded or contracted by displacement of the piezoelectric vibration element to suck ink from a common ink chamber and jet an ink droplet from a nozzle opening; a first drive signal outputting means for outputting a first signal for contracting the piezoelectric vibration element at a predetermined velocity; a second drive signal outputting means for outputting a second signal for expanding the piezoelectric vibration element at a predetermined velocity; a pulse signal generating means for dividing a single recording head drive period into "n" segments (where "n" is an integer that is 2 or greater) and for outputting a pulse signal whose cycle Tp is larger than the Helmholtz cycle Tc in synchronism with a dot forming signal from outside; and a circuit constant adjusting means for adjusting a time constant of the first signal in such a manner that an ink droplet jet out last has a velocity which allows the ink droplet jet out last to be combined with an ink droplet jet out first by the pulse signal during flight.

A recording head is driven at a predetermined cycle for a plurality of times by generating a plurality of pulse signals, each pulse signal having the same cycle Tp that is larger than the Helmholtz cycle Tc within a single drive period, so that all ink droplets jet out within the period of a print signal are combined together during their flight.

DETAILED DESCRIPTION OF THE PREFERRED EMBODIMENTS

Figure 1:
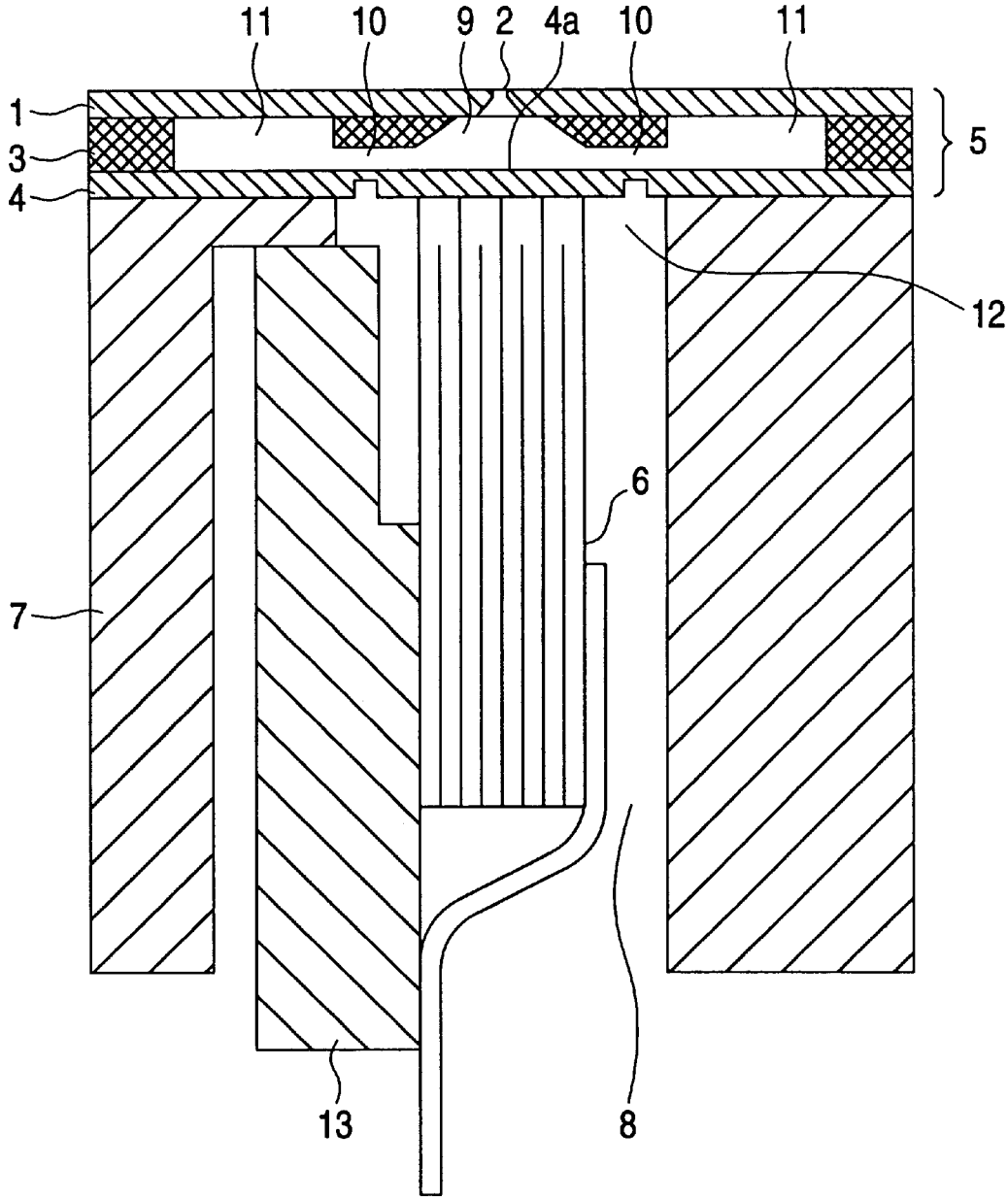
FIG. 1 is a sectional view showing an embodiment of an ink jet recording head according to the present invention.

Details of the invention will now be described with reference to the embodiments shown in the drawings.

FIG. 1 shows an embodiment of an ink jet recording head to be used in the invention. In FIG. 1, reference numeral 1 denotes a nozzle plate having a nozzle opening 2 formed therein; 3, a flow path forming plate having a through hole for defining a pressure producing chamber 9, a through hole or groove for defining two ink supply ports 10 that communicate with both sides of the pressure producing chamber 9, and through holes for defining common ink cambers 11, 11 communicating with these ink supply ports 10, 10; and 4, a vibration plate that resiliently deforms while abutted against an end of a piezoelectric vibration element 6. The nozzle plate 1 and the vibration plate 4 are fixed to both surfaces of the flow path forming plate 3 so as to be impermeable to liquid to thereby form a substrate unit 5.

Reference numeral 7 denotes a base, which has an accommodating chamber 8 for accommodating the piezoelectric vibration element 6. The piezoelectric vibration element 6 is fixed through a fixing board 13 so that an island portion 4*a* of the vibration plate 4 can be abutted against an end of the piezoelectric vibration element 6 that is exposed to an opening 12.

The piezoelectric vibration element 6 operates in a vertical vibration mode, in which displacement takes place in the axial direction of the piezoelectric vibration element. Since the area at the end of the piezoelectric vibration element 6 is extremely small, the capacity of the pressure producing chamber 9 can be designed to be extremely small. As a result, the Helmholtz cycle Tc of the pressure producing chamber 9 can be made smaller than the natural vibration cycle of the piezoelectric vibration element 6. This means that ink in the pressure producing chamber 9 can flow smoothly even if the piezoelectric vibration element 6 is driven at a cycle close to the natural vibration cycle Ta of the piezoelectric vibration element 6. The piezoelectric element is driven at a cycle close to the natural vibration cycle Ta in order to minimize the residual vibration caused after termination of the contraction or expansion of the piezoelectric vibration element 6.

Further, since the flow path impedance Zn of the nozzle opening 2 is set to a value about 1.5 to 3 times larger than the flow path impedance Zr of the ink supply port 10, the movement of the meniscus after the ink has been jet out can be damped rapidly. The rapid damping allows the ink droplet jetting cycle to be set to a value extremely small compared with the cycle of a print signal applied from a host.

Figure 2:
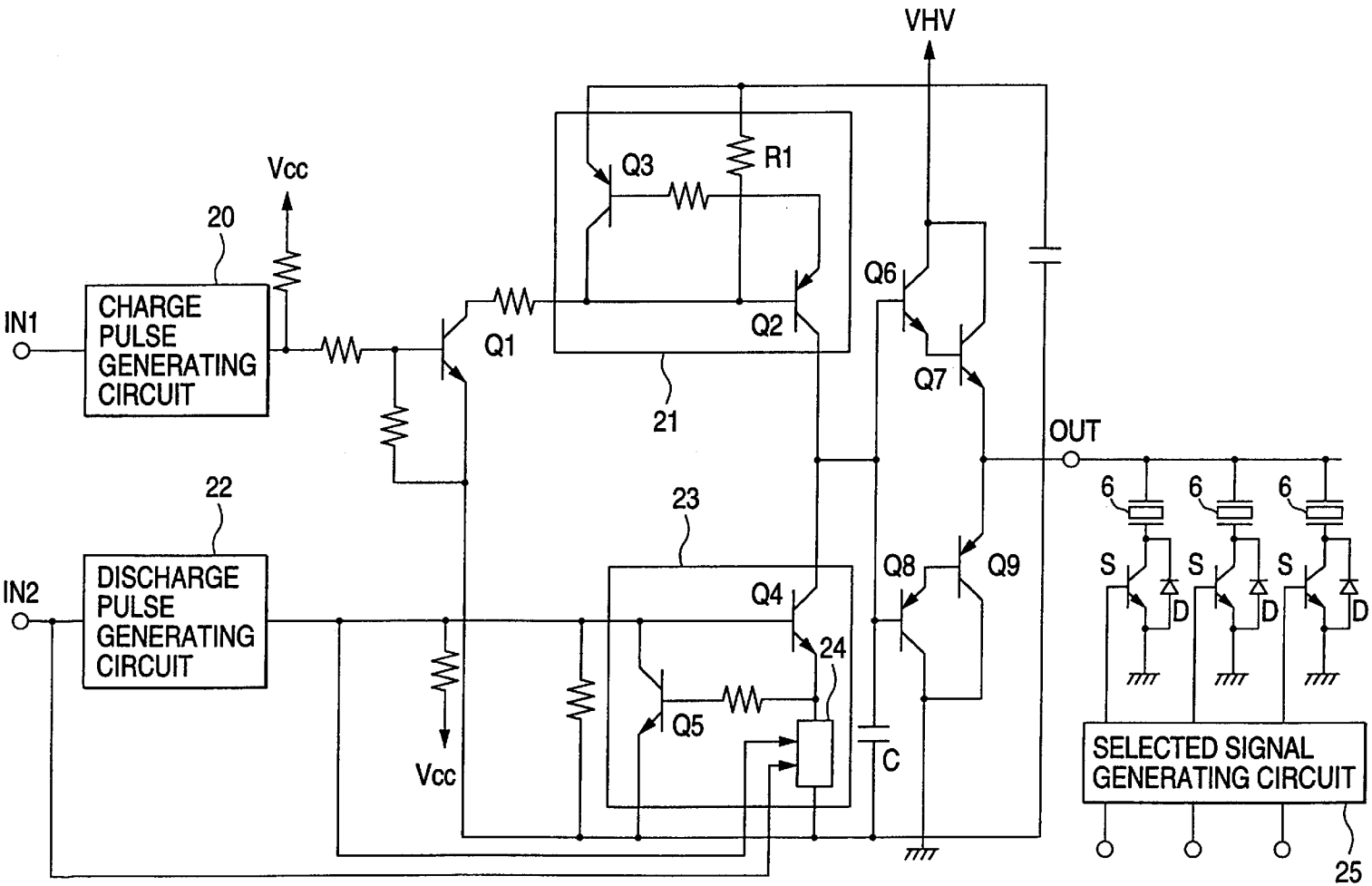
FIG. 2 illustrates an embodiment of the present invention.

FIG. 2 is an embodiment of a drive circuit that drives the ink jet recording head. In FIG. 2, reference numeral IN1 denotes an input terminal for an auxiliary print signal (FIG. 3(*a*)) for contracting the piezoelectric vibration element 6; and IN2 denotes an input terminal for a print signal (FIG. 3(*c*)) for expanding the contracted piezoelectric vibration element 6.

Figure 3:
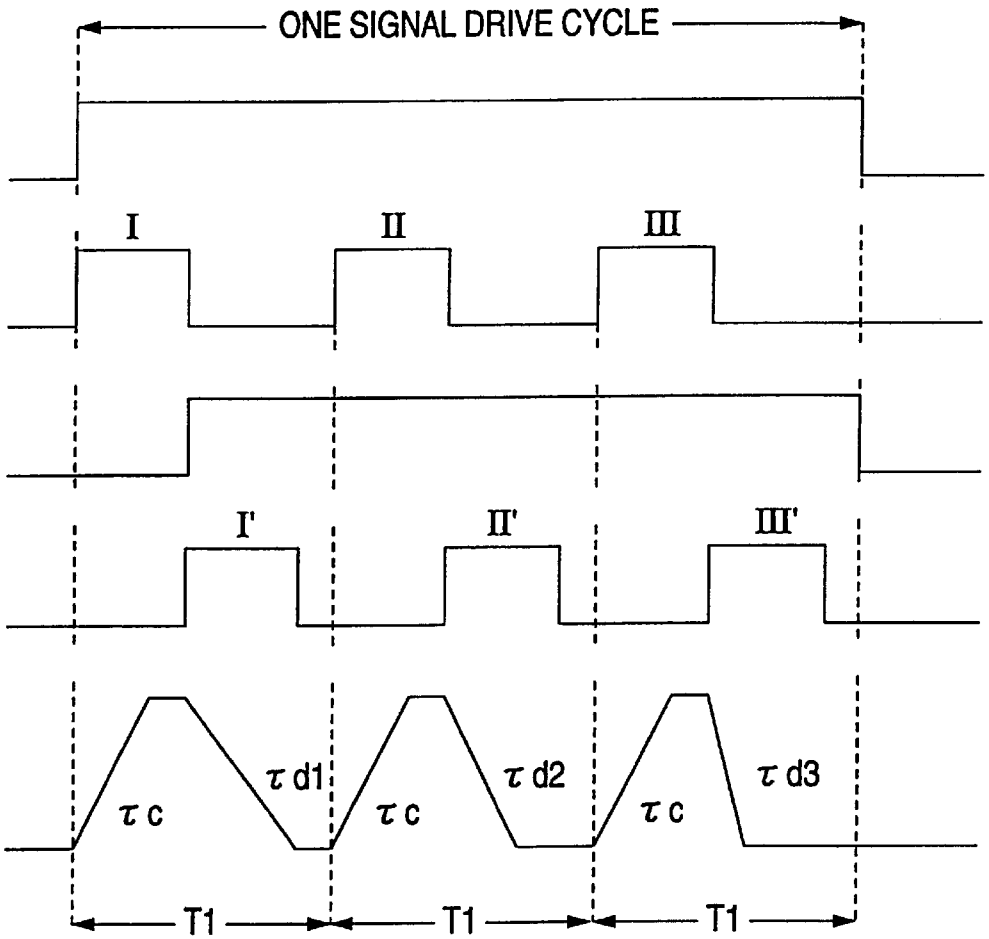
FIGS. 3(*a*) to 3(*e*) illustrate waveforms showing the operation of the embodiment of FIG. 2 for a single drive cycle.

A charge pulse generating circuit 20 is connected to the input terminal IN1. The charge pulse generating circuit 20 divides a single drive cycle into a plurality of segments. The charge pulse generating circuit 20 generates three charge pulses I, II, III, each pulse having a cycle T1, as shown in FIG. 3(*b*) in this embodiment. A first constant current circuit 21 is connected to the output terminal of the charge pulse generating circuit 20 through a level shifting transistor Q1.

The cycle Ti of each of the charge pulses I, II, III and discharge pulses I', II', III' is quite larger than the Helmholtz cycle Tc, and is selected to have a predetermined value. The cycle T1 is set so that the charge pulse generating circuit 20 starts a charge operation and a discharge operation when the pressure producing chamber 9 becomes stable after the ink droplet has been jet out.

The first constant current circuit 21 includes transistors Q2, Q3 and a resistor R1, and is designed to increase the terminal voltage across a capacitor C at a time constant $\tau c$ by charging the capacitor C at a constant current.

In FIG. 2, reference numeral 22 denotes a discharge pulse generating circuit which generates pulse signals of a predetermined cycle by dividing the drive cycle into "n" segments (where "n" is an integer that is 2 or greater), or three pulse signals in this embodiment. The pulse signals are produced within the drive cycle in synchronism with the rise of a print signal. In addition, the discharge pulse generating circuit generates a pulse having a time width that can completely discharge the capacitor C at a maximum time constant $\tau d1$ of a time constant adjusting circuit 24, which is described below.

Reference numeral 23 denotes a second constant current circuit connected to the discharge pulse generating circuit 22. The second constant current circuit 23 includes transistors Q4, Q5 and the time constant adjusting circuit 24 having an adjustable resistor. The second constant current circuit 23 discharges the electric charges stored in the capacitor C by time constants $\tau d1$, $\tau d2$, $\tau d3$ determined by the time constant adjusting circuit 24.

The time constant adjusting circuit 24 cyclically changes the resistance in response to the value of an input pulse every time the discharge pulse I', II', or III' is input. That is, in this embodiment, the time constant $\tau d1$ is set in response to the first discharge pulse I', the time constant $\tau d2$ is set in response to the second discharge pulse II', and the time constant $\tau d3$ is set in response to the third discharge pulse III'. The time constant adjusting circuit 24 resets the set time constant upon fall of the print signal (c) shown in FIG. 3, and is designed to repeat the time constant changing operation in the same way.

A terminal of the capacitor C is connected to an output terminal OUT through a current amplifying circuit in which transistors Q6, Q7 and transistors Q8, Q9 are Darlington-connected.

All the piezoelectric vibration elements 6, 6, 6 •• •• are connected to the output terminal OUT through transistors S, S, S •• •• that are turned on by signals from a selected signal generating circuit 25. The signals of the selected signal generating circuit 25 are obtained by dividing the print signal into a plurality of segments in synchronism with the charge pulses.

The operation of the thus constructed drive circuit will be described in more detail with reference to waveform diagrams shown in FIGS. 3(*a*) to 3(*e*).

Upon application of the auxiliary print signal (a) shown in FIG. 3 to the terminal IN1, the first charge pulse I of the predetermined cycle T1 is output in synchronism with the rising edge of the auxiliary print signal. The first charge pulse I turns on the transistor Q1, which then turns on the transistor Q2 constituting the first constant current circuit 21, so that a constant current flows through the resistor R1 into the capacitor C connected to the transistor Q2.

The terminal voltage across the capacitor C is amplified by the transistors Q6, Q7 and thereafter applied to the respective piezoelectric vibration elements 6 from the output terminal OUT, so that only predetermined piezoelectric vibration elements 6, 6, 6 •• •• are charged at the time constant τc through the transistors S, S, S •• •• selectively turned on by the signals from the selected signal generating circuit 25.

Since the piezoelectric vibration element 6 contracts at the rising time constant τc, the pressure producing chamber 9 expands to allow a predetermined quantity of ink to flow into the pressure producing chamber 9 from the common ink chambers 11.

When a time defined by the pulse width of the charge pulse I has elapsed, the transistor Q1 turns off, which in turn stops the charging of the capacitor C.

After a hold time has elapsed, a print signal (c) shown in FIG. 3 is fed to the print signal input terminal IN2. As a result, the first discharge pulse I' with respect to this print signal is generated from the discharge pulse generating circuit 22 and, at the same time, the time constant of the second constant current circuit 23 is set to a value τd1 by the time constant adjusting circuit 24.

The transistor Q4 constituting the second constant current circuit 23 turns on, so that the electric charges stored in the capacitor C are discharged at the time constant τd1. As a result, the terminal voltage across the capacitor C drops linearly at the falling time constant τd1.

This falling voltage is applied to the output terminal OUT through the transistors Q8, Q9 to be applied to the respective piezoelectric vibration elements 6. However, since only the piezoelectric vibration elements 6 with which to form dots are charged, it is only these piezoelectric vibration elements that are discharged at the falling time constant τd1 through diodes D, D, D •• ••. These piezoelectric vibration elements expand at a velocity defined by the time constant τd1.

The pressure producing chambers 9 expand at a velocity defined by the time constant τd1 as a result of the expansion of the piezoelectric vibration elements 6. The pressure producing chambers jet out ink droplets having a velocity V1 out of the corresponding nozzle openings 2 while applying pressure to the ink in the pressure producing chambers 9.

When the second charge pulse II is generated in synchronism with the print auxiliary signal (a), the aforementioned process is repeated to selectively charge the piezoelectric vibration elements with which to form dots and to supply the ink to the corresponding pressure producing chambers 9 from the common ink chambers 11. Since the second charge pulse II is set to the same time constant τc, the ink is supplied to the pressure producing chambers 9 in a manner similar to the case of the first charge pulse.

Upon the end of charging by the second charge pulse II, the second discharge pulse II' is generated in synchronism with the previously received print signal (c) and, at the same time, the discharge time constant of the second constant current circuit 23 is changed to a value τd2 by the time constant adjusting circuit 24.

The second discharge pulse II' turns on the transistor Q4 constituting the second constant current circuit 23, discharging the electric charges stored in the capacitor C at the discharge time constant τd2, which is smaller than the first discharge time constant. As a result, the piezoelectric vibration elements expand at the time constant τd2.

The corresponding pressure producing chambers 9 contract at a velocity defined by the time constant τd2 and jet ink droplets at a velocity V2 that is faster than the velocity V1 of the ink droplets last jet out.

After the second ink droplets are jet out in this way, the third charge pulse III is applied in synchronism with the auxiliary print signal (a), in a manner similar to the aforementioned case, to expand the pressure producing chambers 9 and to cause the pressure producing chambers 9 to suck in ink.

At the end of charging by the third discharge pulse III, the third discharge pulse III' is generated in synchronism with the previously received print signal (c) and, at the same time, the discharge time constant of the second constant current circuit 23 is changed to a value τd3 by the time constant adjusting circuit 24.

The third discharge pulse III' drops the terminal voltage across the capacitor at the time constant τd3 linearly, and the piezoelectric vibration elements 6 expand at a velocity determined by the time constant τd3. As a result of the expansion of the piezoelectric vibration elements 6, ink droplets are jet out at a velocity V3, which is more or less the same as the velocity V2 of the ink droplets last jet out from the corresponding nozzle openings 2.

The discharge time constants τd1, τd2, τd3 are sequentially decreased, and these values are set so that an ink droplet produced by the second discharge pulse II catches up with an ink droplet produced by the first discharge pulse I before the ink droplet produced by the first discharge pulse I reaches the recording sheet. As a result, the ink droplets produced by both the first and the second discharge pulses combine together during flight.

When the two ink droplets combine together, the velocity of the combined ink droplet becomes equal to an average of the velocities of the two ink droplets, the average being smaller than the velocity of the second ink droplet. Therefore, if the velocity V3 of an ink droplet produced by the third discharge pulse III is set to a value larger than the velocity of the second ink droplet, the three ink droplets combine together into a single ink droplet in the air and is deposited on the recording sheet as a single ink droplet.

As a result, a dot formed by the thus combined ink droplet has a quantity of ink substantially three times that of a dot formed by a single ink droplet. Hence, even if the recording sheet has a large ink absorbing rate, a dot of a desired size can be formed. If the size of a dot in the carriage travel direction as well as in the sheet forward direction is adjusted optimally in accordance with the quality of paper, white stripes can be prevented by eliminating spaces between dots, irrespective of the minimum travel distances of the carriage drive mechanism and sheet forward mechanism.

Upon input of a next print signal, the time constant adjusting circuit 24 is reset so that the discharge time constant is set to τd1 again.

While three ink droplets are produced with respect to a single auxiliary print signal and a single print signal in this embodiment, the number of ink droplets with respect to a single auxiliary print signal and a single print signal can be selected as one, two or more depending on the quality of recording paper or on the density of dots to be formed. As a result, not only printing can be performed in accordance with the quality of paper, but also the density of dots can be varied for the same quality of paper.

Figure 4:
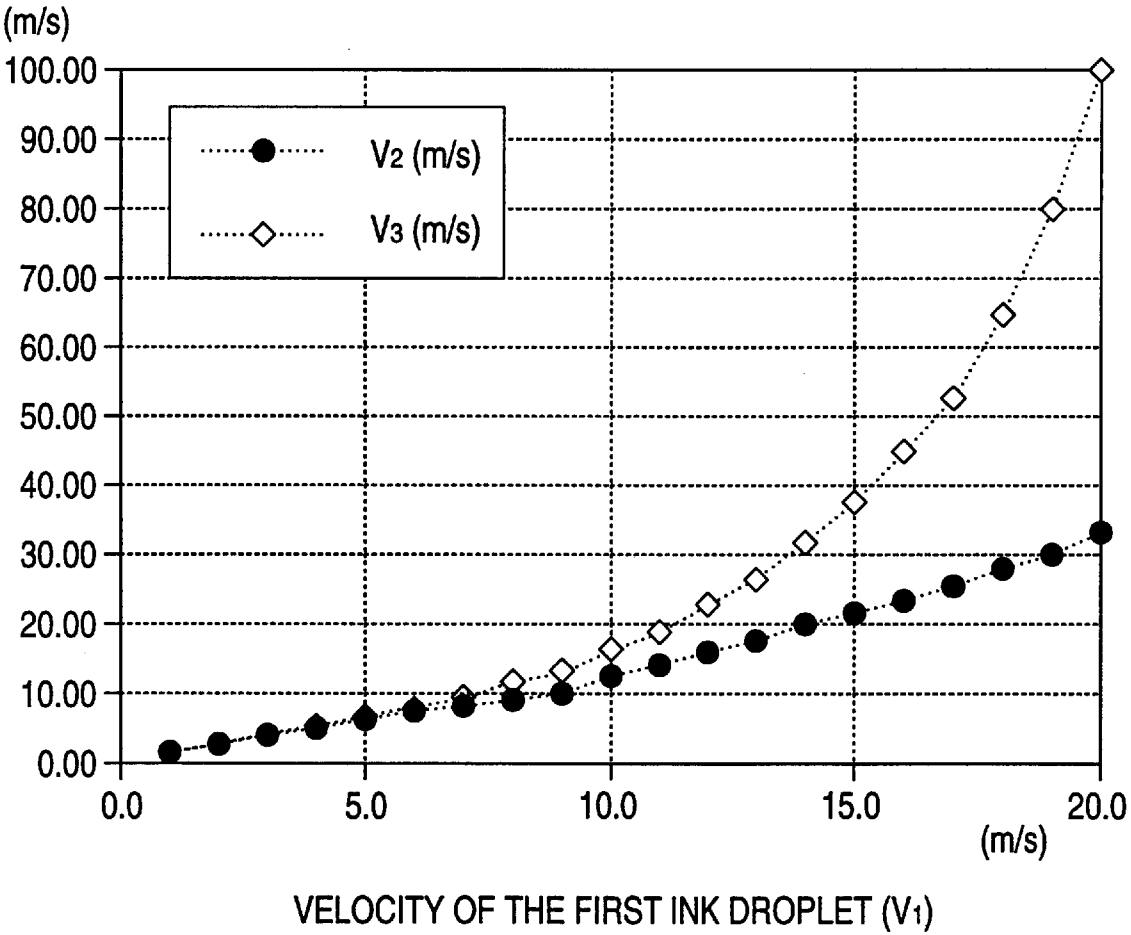
FIG. 4 illustrates the velocities at which a plurality of ink droplets to be combined together in the air with a first ink droplet as a reference.

FIG. 4 shows such a velocity as to allow three ink droplets to be combined on the recording sheet surface simultaneously during the flight of the three ink droplets. The velocity V1 of the first ink droplet is used as a reference when it is assumed that a distance from the nozzle surface of the recording head to the recording sheet, or the so-called platen gap, is set to 1.0 mm. Generally, in ink jet recording heads using piezoelectric vibration elements of the vertical vibration mode, sufficiently high quality printing can be performed as long as the velocity of ink droplets ranges from about 6 to 10 m/s. Therefore, if the velocity V1 of the first ink droplet is set to about 6 to 10 m/s, the second ink droplet and the third ink droplet are caused to fly at such velocities V2 and V3 as to allow the latter ink droplets to be combined with the first ink droplet without difficulty.

Figures 5A, 5B, 5C, 5D:
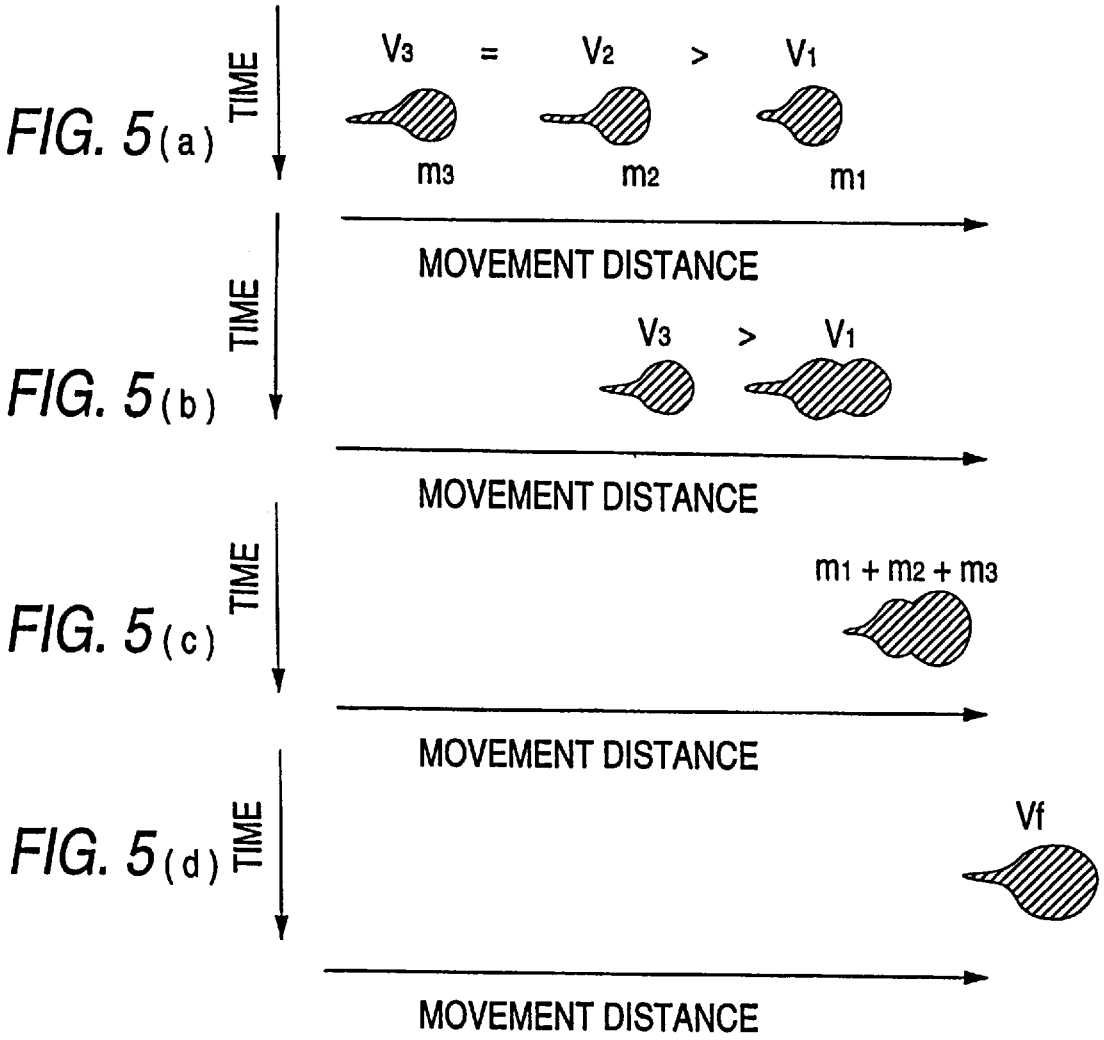
FIGS. 5(*a*) to 5(*d*) illustrate how ink droplets are combined in the embodiment of FIG. 2 and how their velocities change.

When the velocities of the second and third ink droplets are faster than the velocity of the first ink droplet, even if the velocity of the first ink droplet is low, the velocity of an ink droplet at the time of reaching the recording sheet is increased by receiving momenta of the second and third ink droplets, as shown in FIGS. 5(*a*) to 5(*d*).

That is, let it be assumed that, e.g., a plurality "n" (n=3) of ink droplets are jet out at velocities that are related so that V1<V2=V3. Then, even if V1 is 20 m/s or less, the velocity of the first ink droplet is increased when combined with the second and third ink droplets as long as the velocity of the second ink droplet is 20 m/s or more. If the third ink droplet is jet out at the same velocity as the second ink droplet, i.e., V2=V3, then an ink droplet formed by combining the first and second ink droplets combine with the third ink droplet in the air since the ink droplet formed by combining the first and second ink droplets flies slower than the third ink droplet. Therefore, the third ink droplet catches up with the ink droplet formed by combining the first and second ink droplets. It can be said from this fact that as long as the velocities of the second and third ink droplets are 20 m/s or more (e.g., 24 m/s or so although this velocity varies depending on the ink droplet jetting interval), a velocity Vf of a combined ink droplet at the time of reaching the recording sheet can be set to 20 m/s.

When the velocity of the combined ink droplet at the time of deposit on the recording sheet is thus increased, the combined ink droplet expands in all directions in accordance with the momentum thereof at the time the combined ink droplet has reached the surface of the recording sheet. As a result, a large-sized dot can be formed with a small quantity of ink. In printing using many colors, print quality can be improved by preventing mixture of colors between dots by quickening the drying of the ink while increasing the surface area of each dot formed by an ink droplet.

While the ink droplet jetting velocity is adjusted by changing only the discharge time constant while maintaining the ink droplet jetting operation drive cycle constant in the aforementioned embodiment, the ink droplet velocity can be changed by adjusting the quantity of ink forming an ink droplet to be jet out, even if the piezoelectric vibration element 6 expanding and contracting velocity at the time of jetting out the ink droplet is maintained constant.

Figure 6:
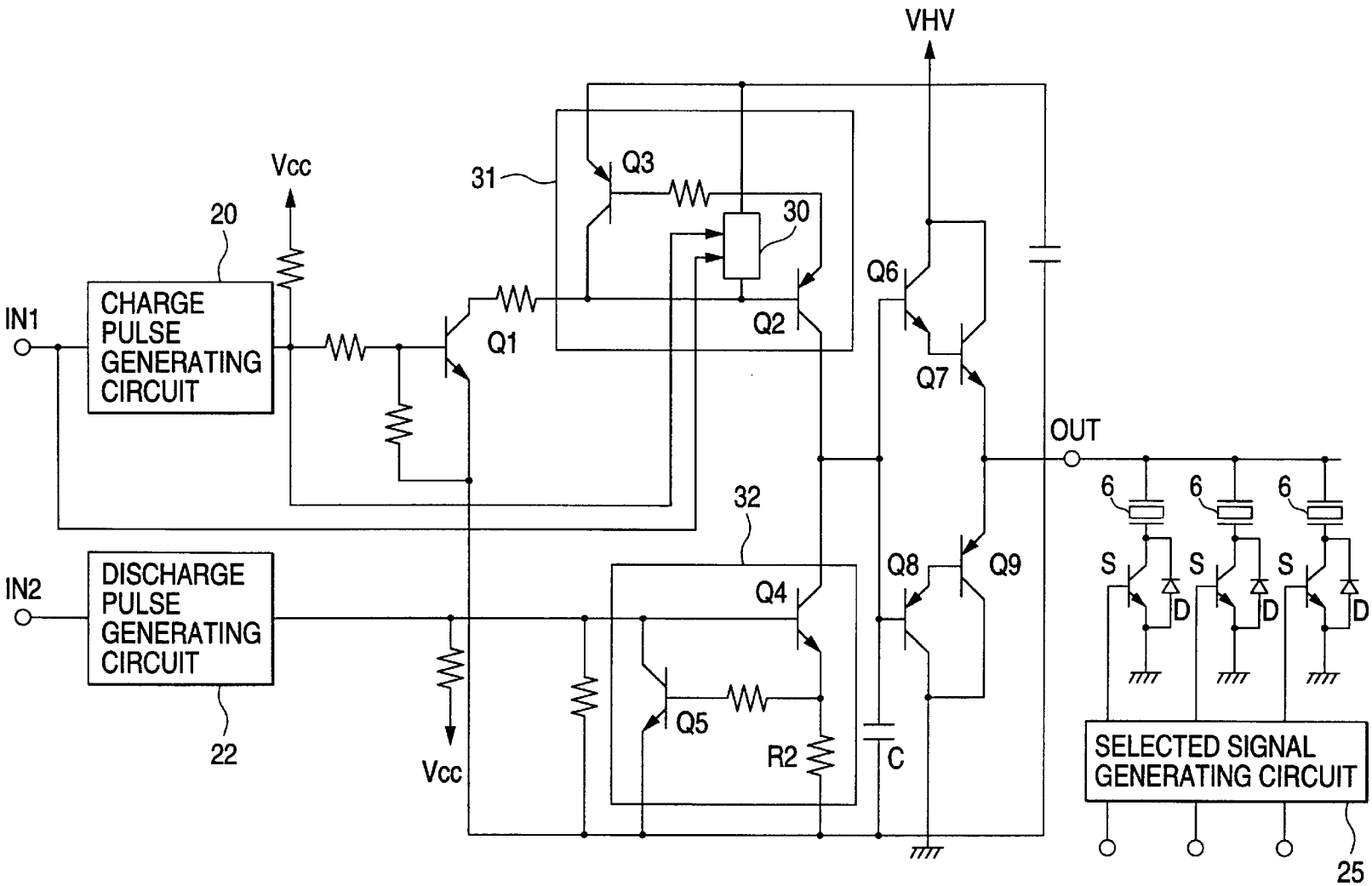
FIG. 6 illustrates another embodiment of the invention.

FIG. 6 shows an embodiment in the case where the velocity of the ink droplet is changed by adjusting the quantity of ink as described above. In FIG. 6, reference numeral 30 denotes a time constant adjusting circuit arranged in a first constant current circuit 31. The time constant adjusting circuit 30 adjusts the time constants of the first constant current circuit 31 to sequentially smaller values τc1, τc2, τc3 by sequentially changing resistances with charge pulses (FIG. 7(*b*)) from the charge pulse generating circuit 20. In addition, the time constant adjusting circuit 30 resets the thus adjusted time constants with the next auxiliary print signal. Reference numeral 32 in FIG. 6 denotes the second constant current circuit, which discharges the electric charges stored in a capacitor C at a predetermined discharge time constant τd defined by the resistance of a resistor R2 and the capacitance of the capacitor C.

The operation of the thus constructed apparatus will be described with reference to FIGS. 7(*a*) to 7(*e*).

Figure 7:
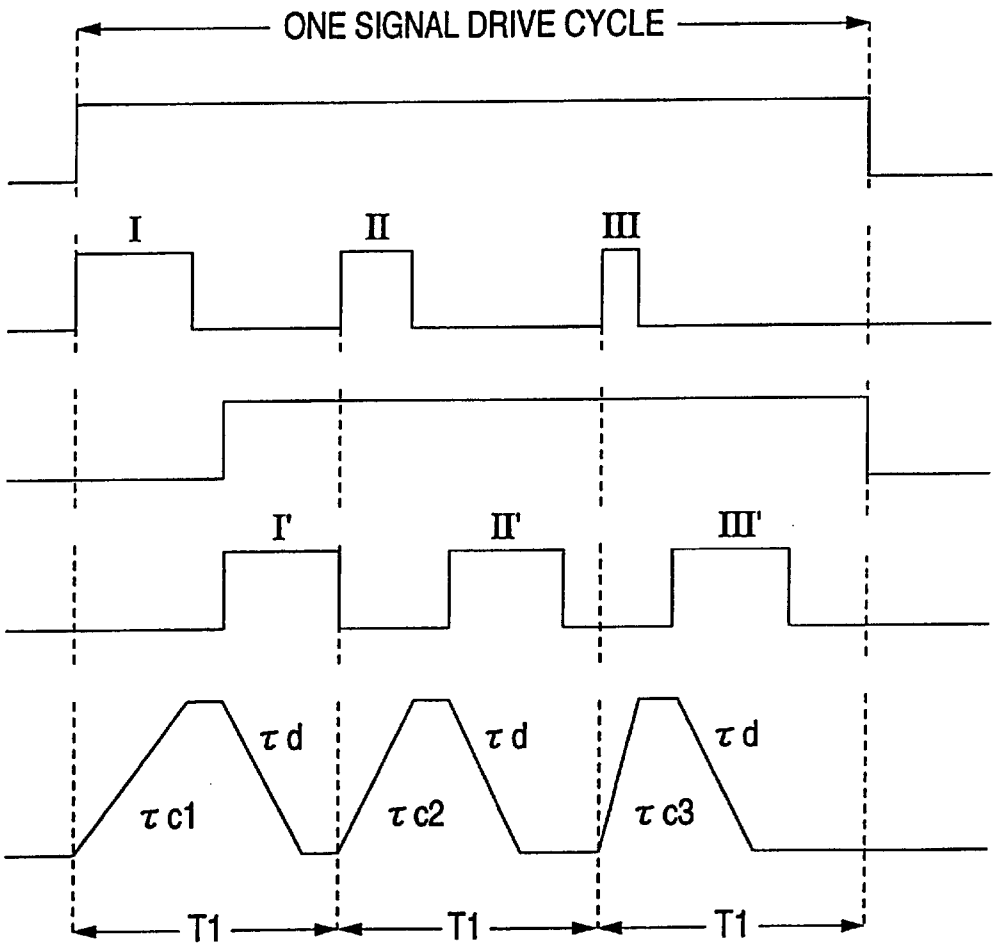
FIGS. 7(*a*) to 7(*e*) illustrate waveforms respectively showing the operation of the embodiment of FIG. 6.

Upon input of an auxiliary print signal (a) shown in FIG. 7 to the terminal IN1, the first charge pulse I is output at a predetermined cycle T1 in synchronism with the rising edge of the auxiliary print signal (a). As a result, the charge time constant τc1 is set to the first constant current circuit 31, which turns on the transistor Q1 at the same time. The capacitor C is then charged by the first constant current circuit 20 at the time constant τc1. Since this causes the piezoelectric vibration element 6 to contract at the large time constant τc1, the corresponding pressure producing chamber 9 expands slowly and the ink is therefore allowed into the pressure producing chamber 9 from the common ink chambers 11 while controlling the size of the meniscus to be as small as possible (the sucking of the meniscus indicated in column I in FIG. 8).

Upon elapse of a time defined by the pulse width of the charge pulse I, the transistor Q1 turns off, which in turn stops the charging of the capacitor C.

After a predetermined time, a print signal (FIG. 7(*c*)) is applied to the print signal input terminal IN2. As a result, the first discharge pulse I' is output from the discharge pulse generating circuit 32, which turns on the transistor Q4 of the second constant current circuit 32. The electric charges stored in the capacitor C are thereafter discharged at the predetermined time constant τd defined by the resistor R2. As a result, the terminal voltage across the capacitor C drops linearly at the time constant τd. At this time, the piezoelectric vibration element 6 expands at a velocity defined by the time constant τd of the discharge current to cause the corresponding pressure producing chamber 9 to contract and to allow the corresponding nozzle opening 2 to jet out an ink droplet having a velocity of V1.

Figure 8:
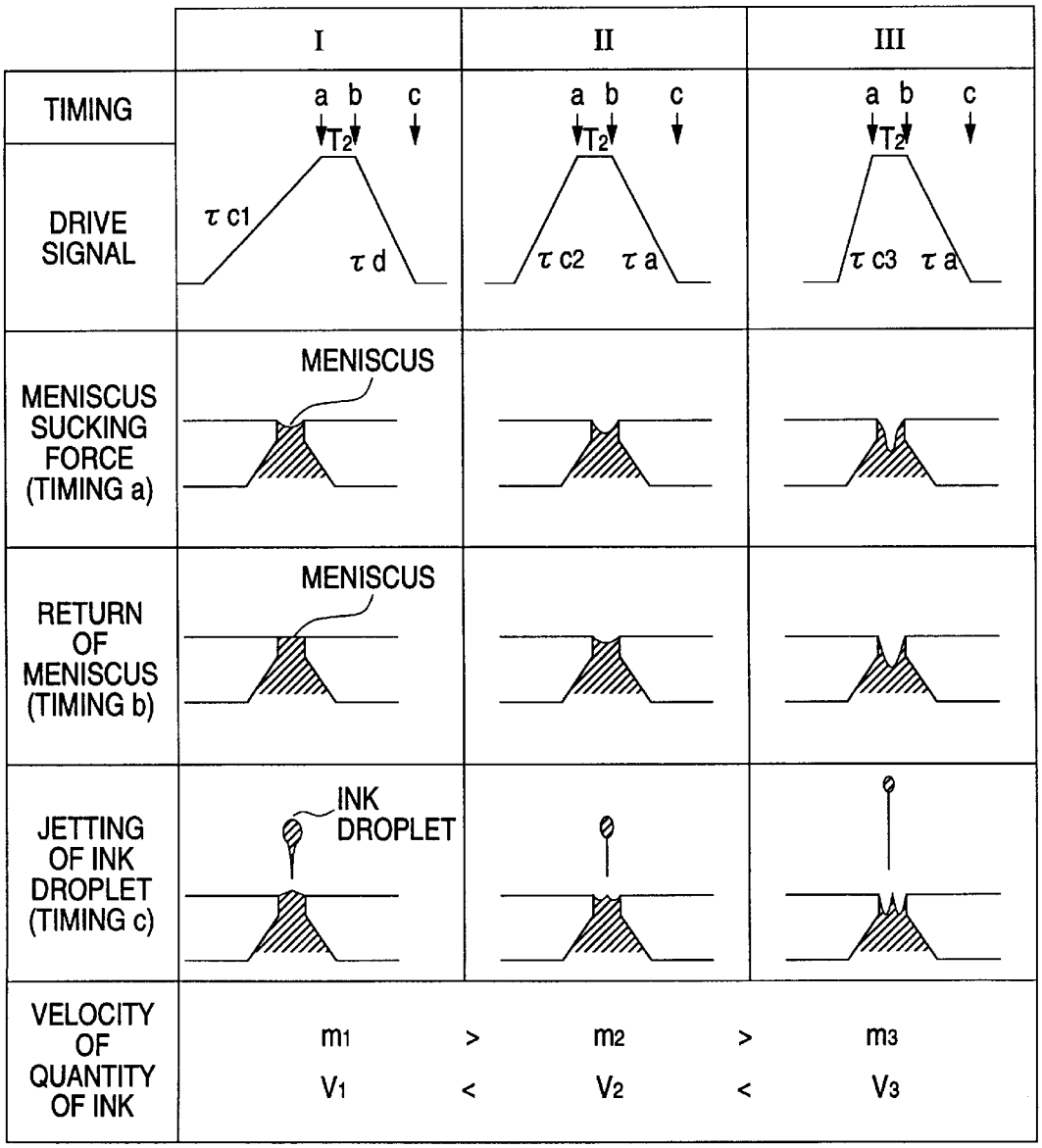
FIG. 8 is a diagram showing how the meniscus of each ink droplet behaves in the embodiment of FIG. 6.

In this case, the meniscus sucking force is small because the time constant τc1 is large, which in turn causes the meniscus to return quickly to the edge of the nozzle opening (the return of the meniscus indicated in column I in FIG. 8). Thus, a large quantity m1 of ink is jet out (the jetting out of the ink droplet indicated in column I in FIG. 8), and the velocity V1 of the ink droplet is low.

When the second charge pulse II is generated in synchronism with the auxiliary print signal (a), the time constant of the time constant adjusting circuit 30 is changed to a value τc2 that is smaller than the last time constant τc1. The last process is repeated to selectively charge only the piezoelectric vibration elements 6 with which to form dots. In the current case, the pressure producing chamber 9 expands slightly rapidly by the time constant τc2, and this increases the meniscus sucking force compared with the meniscus sucking force in the last case (the sucking of the meniscus indicated in column II in FIG. 8).

At the end of charging by the second charge pulse II, the second discharge pulse II' is applied, so that the piezoelectric vibration element 6 expands at the predetermined velocity defined by the time constant τd to cause the corresponding pressure producing chamber 9 to contract.

Although the meniscus sucking force is slightly larger in the current case than in the last case, the second discharge pulse II' is applied immediately. Therefore, a return of the meniscus becomes slightly small (the return of the meniscus indicated in column II in FIG. 8), decreasing a quantity m2 of ink in an ink droplet compared with the quantity m1 in the last case. However, the ink droplet is jet out at a velocity V2 that is faster than the velocity V1 in the last case (the jetting of the ink droplet indicated in column II in FIG. 8).

After the second ink droplet is jet out, the time constant adjusting circuit 30 changes the third time constant τc3 in response to the third charge pulse III generated in synchronism with the auxiliary print signal (a) in a manner similar to the last case. Simultaneously therewith, the pressure producing chamber 9 is expanded by the time constant τc3 to cause the pressure producing chamber 9 to suck the ink.

Since the time constant τc3 is larger than the time constant τc2 in the last case, the meniscus sucking force is increased (the sucking of the meniscus indicated in column III in FIG. 8).

At the end of charging by the third charge pulse III, the third discharge pulse III' is output in synchronism with the previously received print signal (c), causing an ink droplet to be jet out of the corresponding nozzle opening 2. In this case, a return of the meniscus is reduced by an amount comparable to the increase in sucking force (the return of the meniscus indicated in column III in FIG. 8). The quantity m3 of ink in an ink droplet to be jet out is reduced, and the ink droplet flies at a velocity V3 that is faster than the velocity V2 of the last ink droplet (the jetting of the ink droplet indicated in column III in FIG. 8).

Therefore, the second and third ink droplets catch up with the first ink droplet successively before the first ink droplet reaches the recording sheet. This allows the three ink droplets to be combined together in the air and to deposit on the recording sheet.

The above embodiment is suitably applied to the adjustment of tones during the printing operations performed at the same resolution with the hold time T2 (a period from timing a to timing b in FIG. 8) of the maximum voltage at the charging end maintained constant. If the resolution itself is to be changed, a time T3 from the start of charge timing to the ink droplet jet start timing (timing b in FIG. 9) may be maintained constant to make the quantities of successive ink droplets substantially equal to one another (to the extent possible), and the velocity of each successive ink droplet may be increased.

Figure 9:
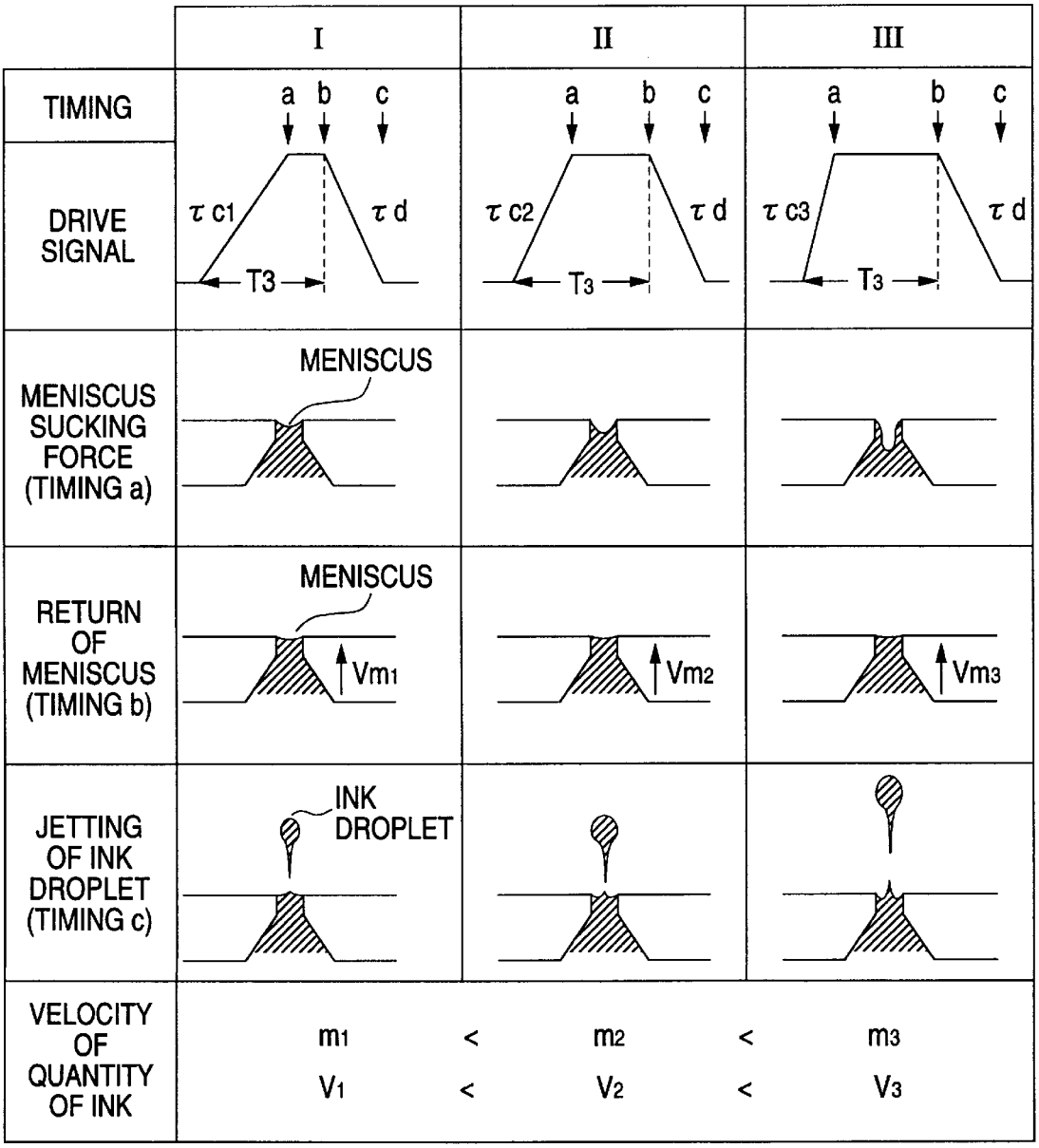
FIG. 9 illustrates another embodiment of the present invention in the form of how the meniscus of each ink droplet behaves.

Since the time constants τc1, τc2, τc3 for the first, second, third rounds of expansion of the pressure producing chamber 9 are sequentially decreased, the meniscus sucking forces increase as indicated by the sucking of the meniscus indicated in columns (I), (II), and (III) in FIG. 9.

On the other hand, since the period from the pressure producing chamber expansion start timing to the ink jetting operation timing (timing b) is fixed to T3, the meniscus returns to substantially the same position as shown by the return of the meniscus in columns I, II, and III in FIG. 9.

However, since the meniscus returning velocities Vm1, Vm2, Vm3 are sequentially increased, the momentum toward the nozzle opening of an ink droplet in the vicinity of the nozzle opening is increased. As a result, even if the pressure producing chamber 9 is contracted at the same time constant τd, not only the quantities m1, m2, m3 of the ink droplets are sequentially increased, but also the velocities V1, V2, V3 thereof are sequentially increased. Therefore, larger ink droplets can be jet out at higher velocities and combined in the air before being deposited on the recording sheet. Thus, printing at largely different resolutions can be performed by a single recording apparatus.

More specifically, printing at a resolution of 1440 dpi can be performed if a single ink droplet is used to form a single dot; printing at a resolution of 720 dpi can be performed if two ink droplets are used to form a single dot by causing the two ink droplets to be combined in the air; and printing at a resolution of 360 dpi can be performed if three ink droplets are used to form a single dot by causing the three ink droplets to be combined in the air.

The velocity of an ink droplet is adjusted by changing the discharge time constant or the charge time constant in the aforementioned embodiment. If both the discharge time constant and the charge time constant are adjusted in such a manner that the velocity of an ink droplet jet out thereafter becomes faster, the size of the ink droplets can be adjusted freely. According to the present invention, a wide variety of types of recording sheets and dot sizes can be accommodated.

Further, an ink droplet that is jet out next has a faster velocity in the aforementioned embodiment. However, as shown in FIG. 5, if the law of conservation of momentum is utilized positively, "n" ink droplets can be combined in the air. That is, if only the first ink droplet is jet out slowly and the succeeding second and third ink droplets are jet out faster than the first ink droplet in such a manner that ink droplets jet out second and thereafter are jet out at the same velocity, i.e., the second ink droplet and "n"th ink droplet are jet out at the same velocity that is faster than that of the first ink droplet (FIG. 5(*a*)), these "n" ink droplets can be combined together in the air.

In other words, when the second ink droplet is combined with the first ink droplet, the velocity V1' of a combined ink droplet is faster than the velocity V1 of the first ink droplet, but is slower than the velocity V2 of the second ink droplet (FIG. 5(*b*)). When the third ink droplet is jet out at the same velocity as the second ink droplet, i.e., V3=V2, then the third ink droplet catches up with the flying ink droplet formed by combining the first and second ink droplets (FIG. 5(*c*)). Finally, an ink droplet having a quantity m1+m2+m3 of ink and having a velocity of Vf deposits on the recording sheet (FIG. 5(*d*)).

Figure 10:
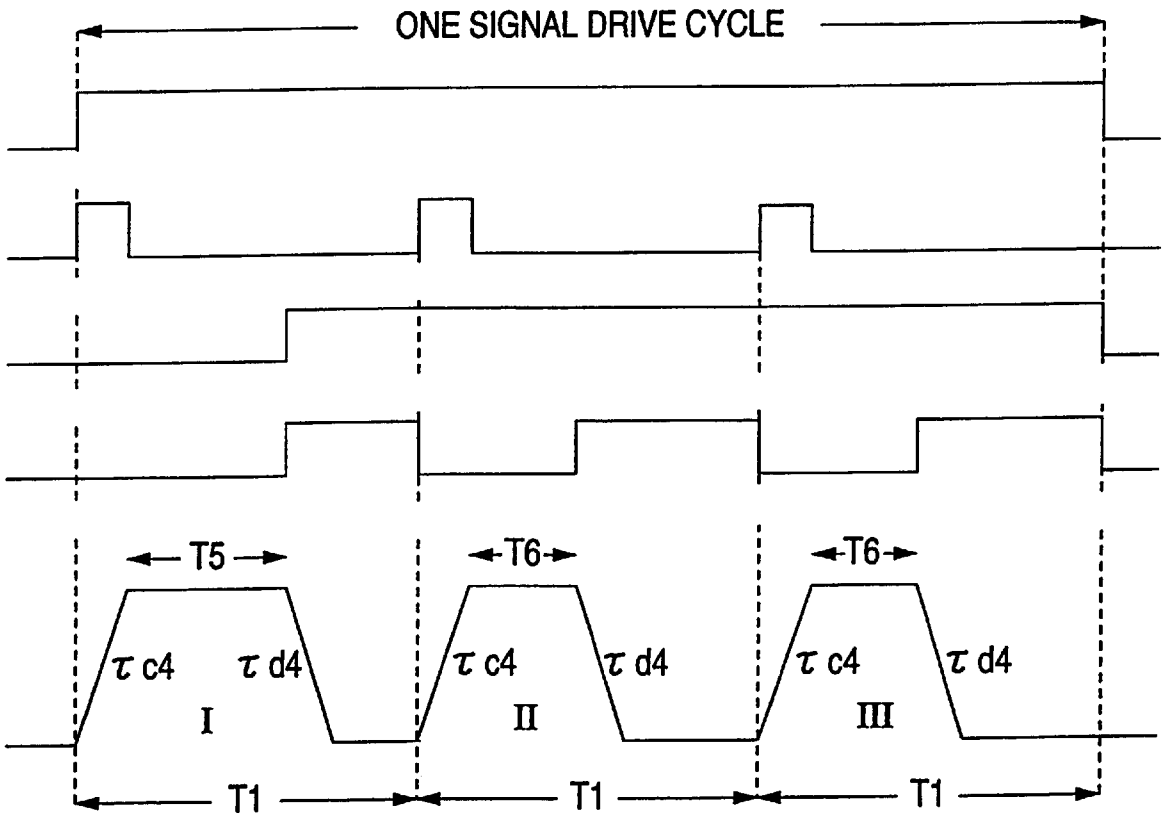
FIGS. 10(*a*) to 10(*e*) are diagrams showing the operation of another embodiment of the present invention.

FIGS. 10(*a*) to 10(*e*) show another embodiment of the invention in the form of waveforms. This embodiment is characterized as using a plurality of waveforms in which both a charge time constant τc4 for contracting the piezoelectric vibration elements to expand the corresponding pressure producing chambers, and a discharge time constant τd4 for expanding the piezoelectric vibration elements to contract the corresponding pressure producing chambers, are maintained constant and in which hold times T5, T6 are set to be different. That is, in this embodiment, first, second and third drive waveforms I, II, III are applied at a predetermined cycle T1.

Specific values of these waveforms I, II, III are as follows. The charge time constant τc4 is set to 8 μs; the discharge time constant τd4 is set to 8 μs; the hold time T5 of the first drive waveform I is set to 12 μs; and the hold time T6 of each of the second and third drive waveforms II, III is set to 8 μs.

Figure 11:
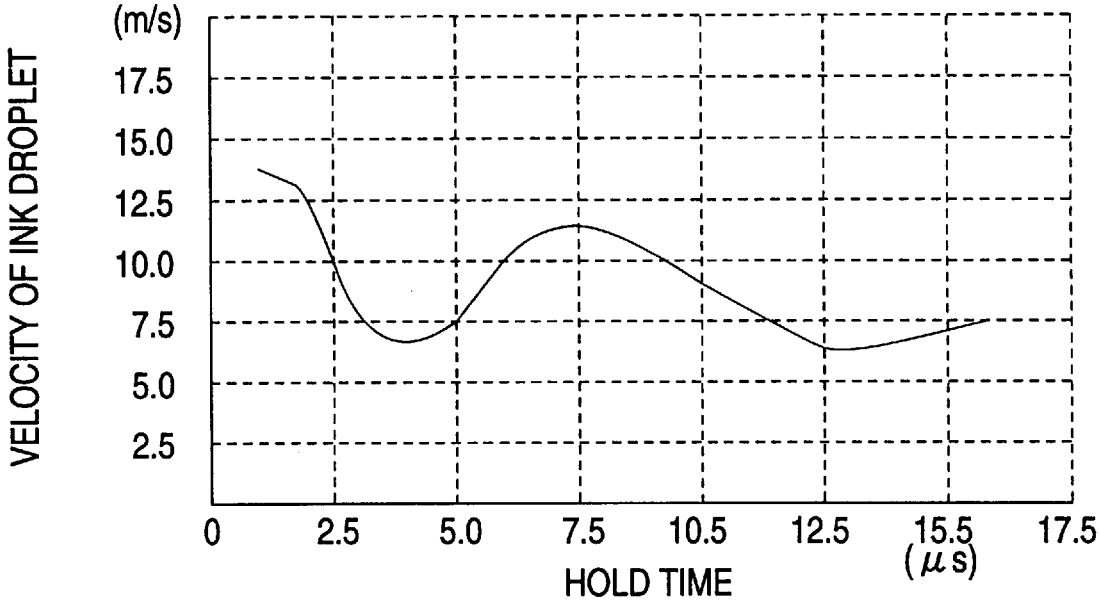
FIG. 11 is a diagram showing hold time in function of ink droplet velocity.
Figure 12:
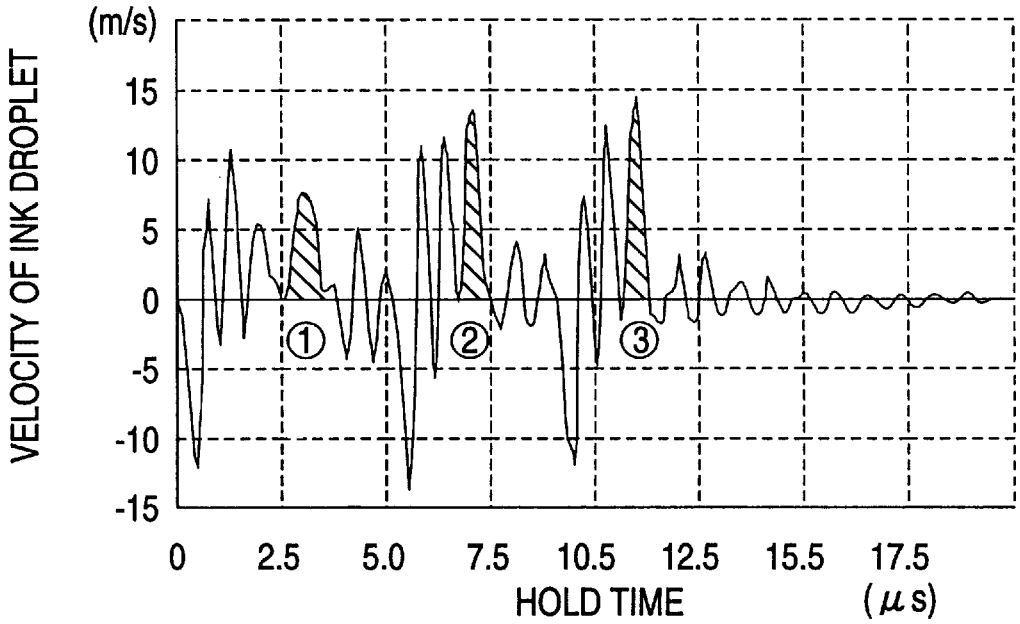
FIG. 12 is a diagram showing hold time in function of successively jet out ink droplet velocity.
Figures 13A, 13B, 13C:
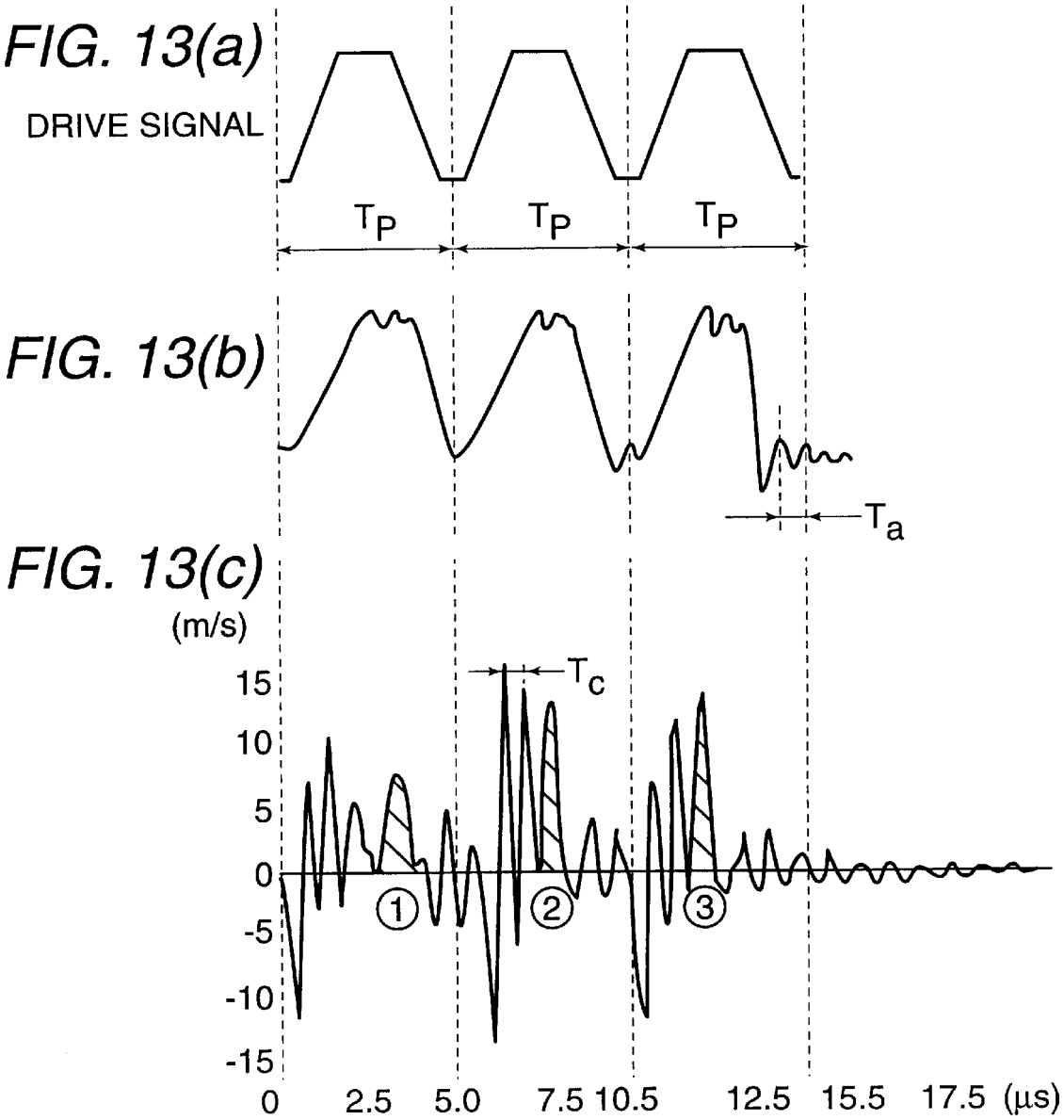
FIGS. 13(*a*) to 13(*c*) illustrate a charge pulse cycle, a natural vibration cycle and a Helmholtz cycle, respectively.

As shown in FIG. 11, the velocity of an ink droplet jet out by the first drive waveform is equal to 6.5 m/s ((1) in FIG. 12) and the velocities of ink droplets jet out by the second and third drive waveforms are substantially equal to 13 m/s ((2) and (3) in FIG. 12), which are minimum velocities for keeping satisfactory print quality. The ink droplets produced by the first and second drive waveforms I, II are combined together in the air. The combined ink droplet flies at a velocity, i.e., about 9 m/s, which is an average of the first and second ink droplet velocities and which is lower than the velocity of the second ink droplet. Therefore, the ink droplet produced by the third drive waveform III, which is the same waveform as the second drive waveform II, is combined with the combined ink droplet formed of the first and second ink droplets during their flight to reach the recording medium with the three ink droplets combined together.

According to this embodiment, not only the charge time constant τc4 and the discharge time constant τd4, which are both relatively hard to design and adjust in terms of forming a circuit configuration, are maintained constant, but the cycle of each drive waveform is also maintained constant. Therefore, the designing of the drive circuit can be simplified.

Moreover, while the recording head using piezoelectric vibration elements of the vertical vibration mode have been exemplified in the aforementioned embodiment, it is apparent that similar advantages can be obtained by applying the invention to recording heads using piezoelectric vibration elements of the flexible vibration mode in which high-speed drive is implemented with thin film designs.

As described in the foregoing, the invention is characterized as including: a recording head having a piezoelectric vibration element whose natural vibration cycle is Ta and a pressure producing chamber whose Helmholtz cycle is Tc, the pressure producing chamber being expanded or contracted by displacement of the piezoelectric vibration element to thereby suck in ink from a common ink chamber and to jet out an ink droplet from a nozzle opening; a first drive signal outputting means for outputting a first signal for contracting the piezoelectric vibration element at a predetermined velocity; a second drive signal outputting means for outputting a second signal for expanding the piezoelectric vibration element at a predetermined velocity; a pulse signal generating means for dividing a single recording head drive period into "n" segments (where "n" is an integer that is 2 or greater) and outputting a pulse signal whose cycle Tp is larger than the Helmholtz cycle Tc in synchronism with a dot forming signal from outside; and a circuit constant adjusting means for adjusting a time constant of at least one of the first and second drive signal outputting means in such a manner that an ink droplet last jet out has such a velocity as to allow the ink droplet to be combined with an ink droplet previously jet out by the pulse signal during their flight. Therefore, the recording head is driven regularly for a plurality of times at a predetermined cycle with respect to a single print signal by generating a plurality of pulse signals, each pulse signal having the same cycle Tp that is larger than the Helmholtz cycle Tc, within a single drive period. As a result of this operation, areal gradation can be implemented by allowing a plurality of ink droplets to be combined in the air without requiring that the cycle at which to jet out each ink droplet to be changed.

What is claimed is:

1. An ink jet recording apparatus comprising:

a recording head comprising:

at least one piezoelectric vibration element having a natural vibration cycle Ta, a pressure producing chamber corresponding to said at least one piezoelectric element and having a Helmholtz cycle Tc, a volume of said pressure producing chamber being changed in accordance with one of the contraction and expansion of said at least one piezoelectric vibration element;

an ink chamber, connected to said pressure producing chamber, for storing a reservoir of ink, said ink chamber communicating with a nozzle opening via said pressure producing chamber;

wherein ink is supplied to said pressure producing chamber and jet out from said at least one nozzle opening in response to displacement of said at least one piezoelectric vibration element; and a drive circuit, connected to said at least one piezoelectric vibration clement, comprising:

pulse signal generating means for dividing a single recording head drive period, during which a printing drop is formed, into n segments, n being an integer having a value of at least two, and for outputting, in synchronism with a signal supplied from an external source, a drive signal having a charge pulse cycle of Tp having a first drive signal and a second drive signal;

first drive signal outputting means for outputting said first drive signal for contracting said at least one piezoelectric vibration element at a predetermined velocity;

second drive signal outputting means for outputting said second drive signal for expanding said at least one piezoelectric vibration element at a predetermined velocity;

time constant adjusting means for generating a plurality of time constants of a charge rate of said first drive signal, the plurality of time constants being in one-to-one correspondence with said n segments, wherein said time constant adjusting means is configured to adjust said first drive signal wherein an ink droplet most recently jet out from said at least one nozzle opening has a velocity which provides for a combination of said ink droplet, in the air, with another ink droplet previously jet out from said at least one nozzle opening.

2. The ink jet recording apparatus according to claim 1, wherein said pulse cycle Tp is larger than said Helmholtz cycle Tc.

3. The ink jet recording apparatus according to claim 1, wherein said time constant adjusting means is configured to generate the plurality of time constants of said first drive signal outputting means in such a manner that respective velocities of ink droplets jet out in response to said drive signal are sequentially increased.

4. The ink jet recording apparatus according to claim 1, wherein said time constant adjusting means is configured to generate the plurality of time constants of said first drive signal outputting means in such a manner that respective quantities of ink droplets jet out in response to said drive signal are sequentially decreased.

5. The ink jet recording apparatus according to claim 1, wherein said time constant adjusting means is configured to generate the plurality of time constants of said first drive signal outputting means in such a manner that a velocity of a first ink droplet is less than respective velocities of ink droplets subsequently jet out from said nozzle opening.

6. The ink jet recording apparatus according to claim 5, wherein said respective velocities of said ink droplets are equal.

7. The ink jet recording apparatus according to claim 1, wherein said time constant adjusting means is configured to generate the plurality of time constants of said first drive signal outputting means in such a manner that quantities of ink in ink droplets jet out from said nozzle opening to a first ink droplet are respectively less than the quantity of ink in said first ink droplet.

8. The ink jet recording apparatus according to claim 1, wherein said second drive signal outputting means comprises a discharging circuit.

9. The ink jet recording apparatus according to claim 8, wherein said discharging circuit comprises a capacitor and a resistor.

10. The ink jet recording apparatus according to claim 1, wherein said first drive signal outputting means comprises a charging circuit.

11. The ink jet recording apparatus according to claim 10, wherein said charging circuit comprises a capacitor and a resistor.

12. The ink jet recording apparatus according to claim 1, further comprising an amplifying circuit, coupled to said at least one piezoelectric vibration element, which amplifies said first drive signal and said second drive signal supplied to said at least one piezoelectric vibration element.

13. The ink jet recording apparatus according to claim 1, further comprising a selecting means for selecting appropriate ones of piezoelectric vibration elements required for printing when said recording head comprises a plurality of piezoelectric vibration elements.

14. An ink jet recording apparatus comprising:

a recording head comprising:

at least one piezoelectric vibration element having a natural vibration cycle Ta, a pressure producing chamber corresponding to said at least one piezoelectric vibration element and having a Helmholtz cycle Tc, a volume of said pressure producing chamber being changed in accordance with one of the contraction and expansion of said at least one piezoelectric vibration element;

an ink chamber, connected to said pressure producing chamber, for storing a reservoir of ink, said chamber communicating with a nozzle opening via said pressure producing chamber;

a drive circuit, connected to said at least one piezoelectric vibration element, comprising:

pulse signal generating means for dividing a single recording head drive period, during which a printing drop is formed, into n segments, n being an integer having a value of at least two, to form a pulse signal, and for outputting, in sychronism with a signal supplied from an external source said pulse signal having a charge pulse cycle of Tp having a first drive signal and a second drive signal;

first drive signal outputting means for outputting said first drive signal for contracting said at least one piezoelectric vibration element at a predetermined velocity;

second drive signal outputting means for outputting said second drive signal for expanding said at least one piezoelectric vibration element at a predetermined velocity; and time adjusting means for adjusting a time between said first drive signal and said second drive signal for jetting out a first ink droplet within said single recording head drive period to be larger than a time between another set of said first and second drive signals within said single recording drive period, wherein ink droplets jet out of said recording head within said single recording drive period are combined together in the air to form a single ink droplet.

15. A method for performing ink jet printing with an ink jet recording apparatus comprising a recording head having at least one piezoelectric vibration element having a natural vibration cycle Ta, a pressure producing chamber corresponding to said at least one piezoelectric vibration element and having a Helmholtz cycle Tc, an ink chamber for storing a reservoir of ink which is in communication with at least one nozzle opening corresponding to said pressure producing chamber, said method comprising:

dividing a single recording head drive cycle, during which a printing drop is formed, into n segments, n being an integer having a value of at least two, to form a drive signal having a first drive signal and a second drive signal;

outputting said first drive signal for contracting said at least one piezoelectric vibration element at a predetermined velocity;

outputting said second drive signal for expanding said at least one piezoelectric vibration element at a predetermined velocity;

outputting, in synchronism with a signal supplied from an external source, said pulse signal having a pulse cycle Tp; and generating a plurality of time constants of a charge rate of said first drive signal to control the velocity of ink droplets jet out of said recording head, the plurality of time constants being in one-to-one correspondence with said n segments, wherein said generating step includes generating the plurality of time constants of said first drive signal in a manner such that an ink droplet most recently jet out from said at least one nozzle opening has a velocity which provides for a combination of said ink droplet, in the air, with another ink droplet previously jet out from said at least one nozzle opening.

16. The method according to claim 15, further comprising the step of setting said pulse cycle Tp to a value larger than said Helmholtz cycle Tc.

17. The method according to claim 15, wherein said providing step comprises a step of generating the plurality of time constants of said first drive signal outputting means in a manner such that respective velocities of ink droplets jet out in response to said drive signal are sequentially increased.

18. The method according to claim 15, wherein said generating step comprises a step of generating the plurality of time constants of said first drive signal outputting means in a manner such that respective quantities of ink droplets jet out in response to said drive signal are sequentially increased.

19. The method according to claim 15, wherein said generating step comprises a step of generating the plurality of time constants of said first drive signal outputting means in a manner such that a velocity of a first ink droplet is less than respective velocities of ink droplets subsequently jet out from said nozzle opening.

20. The method according to claim 15, further comprising the step of setting said respective velocities of said ink droplets to be equal.

21. The method according to claim 15, wherein said generating step comprises a step of generating the plurality of time constants of said first drive signal outputting means in a manner such that quantities of ink in ink droplets jet out from said recording head subsequent to a first ink droplet are respectively less than the quantity of ink in said first ink droplet.

22. The method according to claim 15, further comprising the step of amplifying circuit said first drive signal and said second drive signal supplied to said at least one piezoelectric vibration element.

23. The method according to claim 15, further comprising the step of selecting appropriate ones of piezoelectric vibration elements required for printing when said recording head comprises a plurality of piezoelectric vibration elements.

24. A method for performing ink jet printing with an ink jet recording apparatus comprising a recording head having at least one piezoelectric vibration element having a natural vibration cycle Ta, a pressure producing chamber corresponding to said at least one piezoelectric vibration element and having a Helmholtz cycle Tc, an ink chamber for storing a reservoir of ink which is in communication with at least one nozzle opening corresponding to said pressure producing chamber, said method comprising:

dividing a single recording head drive signal, during which a printing drop is formed, into n segments, n being an integer having a value of at least two, to form a drive signal having a first drive signal and a second drive signal;

outputting said first drive signal for contracting said at least one piezoelectric vibration element at a predetermined velocity;

outputting said second drive signal for expanding said at least one piezoelectric vibration element at a predetermined velocity;

outputting, in synchronism with a signal supplied from an external source, said pulse signal having a charge pulse cycle of Tp; and adjusting a time between said first drive signal and said second drive signal for jetting out a first ink droplet within a single drive cycle to be larger than a time between another set of said first and second drive signals within said single drive cycle, wherein ink droplets jet out of said recording head within said single drive cycle are combined together in the air to form a single ink droplet.

25. An ink jet recording apparatus comprising:

a recording head comprising:

at least one piezoelectric vibration element having a natural vibration cycle Ta, a pressure producing chamber corresponding to said at least one piezoelectric element and having a Helmholtz cycle Tc, a volume of said pressure producing chamber being changed in accordance with one of the contraction and expansion of said at least one piezoelectric vibration element;

an ink chamber, connected to said pressure producing chamber, for storing a reservoir of ink, said ink chamber communicating with a nozzle opening via said pressure producing chamber;

wherein ink is supplied to said pressure producing chamber and jet out from said at least one nozzle opening in response to displacement of said at least one piezoelectric vibration element; and a drive circuit, connected to said at least one piezoelectric vibration element, comprising:

a pulse signal generator which divides a single recording head drive period, during which a printing drop is formed, into n segments, n being an integer having a value of at least two, and for outputting, in synchronism with a signal supplied from an external source, a drive signal having a charge pulse cycle of Tp having a first drive signal and a second drive signal;

a first drive signal generator which outputs said first drive signal for contracting said at least one piezoelectric vibration element at a predetermined velocity;

a second drive signal generator which outputs said second drive signal for expanding said at least one piezoelectric vibration element at a predetermined velocity;

a time constant adjuster which generates a plurality of time constants of a charge rate of said first drive signal, said plurality of time constants being in one-to-one correspondence with said n segments, wherein said time constant adjuster is configured to adjust said first drive signal wherein an ink droplet most recently jet out from said at least one nozzle opening has a velocity which provides for a combination a combination of said ink droplet, in the air, with another ink droplet previously jet out from said at least one nozzle opening.

26. An ink jet recording apparatus comprising:

a recording head comprising:

at least one piezoelectric vibration element having a natural vibration cycle Ta, a pressure producing chamber corresponding to said at least one piezoelectric vibration element and having a Helmholtz cycle Tc, a volume of said pressure producing chamber being changed in accordance with one of the contraction and expansion of said at least one piezoelectric vibration element;

an ink chamber, connected to said pressure producing chamber, for storing a reservoir of ink; and a nozzle plate, disposed opposite to said pressure producing chamber, and having at least one nozzle opening corresponding to said pressure producing chamber; and a drive circuit, connected to said at least one piezoelectric vibration element, comprising:

a first drive signal generator which outputs a first drive signal for contracting said at least one piezoelectric vibration element at a predetermined velocity;

a second drive signal generator which outputs a second drive signal for expanding said at least one piezoelectric vibration element at a predetermined velocity;

a pulse signal generator which divides a single recording head drive period into n segments, n being an integer having a value of at least two, and for outputting, in synchronism with a signal supplied from an external source, a pulse signal having a charge pulse cycle Tp; and a time adjuster which adjusts a time between said first drive signal and said second drive signal for jetting out a first ink droplet within a single drive cycle to be larger than a time between another set of said first and second drive signals within said single drive cycle, wherein ink droplets jet out of said recording head within said single drive cycle are combined together in the air to form a single ink droplet.

* * * * *